US009322137B2

(12) United States Patent
Aboulcaid

(10) Patent No.: US 9,322,137 B2
(45) Date of Patent: Apr. 26, 2016

(54) METHOD FOR BUILDING STRUCTURES, PARTICULARLY PASSAGES UNDER OPERATING RAILWAYS OR THE LIKE

(76) Inventor: Mustapha Aboulcaid, Villejuif (FR)

( * ) Notice: Subject to any disclaimer, the term of this patent is extended or adjusted under 35 U.S.C. 154(b) by 74 days.

(21) Appl. No.: 14/343,965

(22) PCT Filed: Aug. 21, 2012

(86) PCT No.: PCT/FR2012/000340
§ 371 (c)(1),
(2), (4) Date: Jun. 17, 2014

(87) PCT Pub. No.: WO2013/038071
PCT Pub. Date: Mar. 21, 2013

(65) Prior Publication Data
US 2015/0191877 A1 Jul. 9, 2015

(30) Foreign Application Priority Data
Sep. 13, 2011 (FR) ..... 11 02766

(51) Int. Cl.
*E01D 21/00* (2006.01)
*E01C 1/04* (2006.01)
*E02D 29/045* (2006.01)
*E02D 29/055* (2006.01)

(52) U.S. Cl.
CPC . *E01C 1/04* (2013.01); *E01D 21/00* (2013.01); *E02D 29/045* (2013.01); *E02D 29/055* (2013.01)

(58) Field of Classification Search
CPC ..... E01C 1/04; E01D 21/00; E02D 29/045; E02D 29/055
USPC ..... 14/77.1, 78, 26
See application file for complete search history.

(56) References Cited

U.S. PATENT DOCUMENTS 3,363,521 A * 1/1968 Gardner ..... 404/1
4,405,260 A * 9/1983 Tsai et al. ..... 405/184
4,564,967 A * 1/1986 Vidal ..... 14/75

(Continued)

FOREIGN PATENT DOCUMENTS

| | | | |
|---|---|---|---|
| BE | 785 886 | A1 | 11/1972 |
| DE | 392 341 | C | 3/1924 |
| DE | 579 544 | C | 6/1933 |
| EP | 1 820 934 | A1 | 8/2007 |
| FR | 2 650 848 | A1 | 2/1991 |
| JP | 2003 193495 | A | 7/2003 |
| WO | WO 97/19230 | A1 | 5/1997 |

OTHER PUBLICATIONS

International Search Report, Nov. 20, 2012, from International Phase of the instant application.
Communication about intention to grant a European patent, Feb. 24, 2014, from corresponding application EP2649242.

*Primary Examiner* — Raymond W Addie
(74) *Attorney, Agent, or Firm* — Paul & Paul

(57) ABSTRACT

Method for building structures, particularly passages under operating railways or the like. The invention relates to a method for considerably reducing the occurrence and duration of temporary service interruptions required for building underpasses. After temporarily interrupting service on the tracks (9) and placing said tracks perpendicular to the site in the embankment of the passage that is to be built, the top of the embankment is cleared of soil in order to allow the deck (4) to be built and sealed (7), then the work area is backfilled (8) and the tracks are put back in place in order to allow traffic to resume at the end of the service interruption period. The side walls (10) of the passage are built by digging channels down to the foundation, placing reinforcement and pouring cement therein, then the interior of the passage is graded in preparation for the eventual permanent bottom slab (16).

1 Claim, 8 Drawing Sheets

(56) References Cited

U.S. PATENT DOCUMENTS

Figure 8:
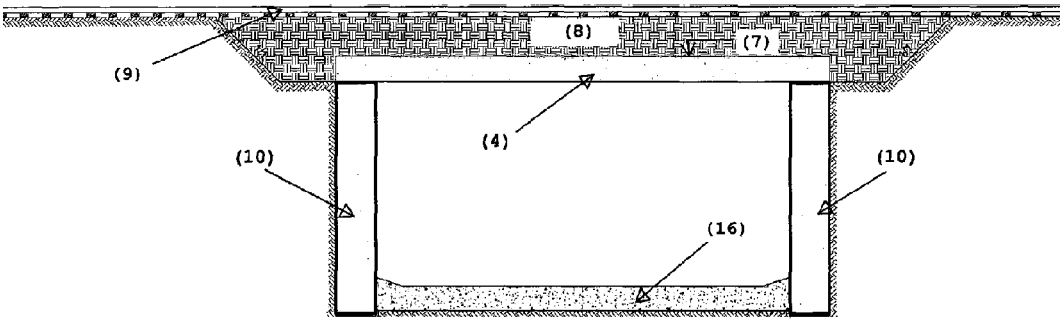

| | | | | |
|---|---|---|---|---|
| 4,735,234 | A | 4/1988 | Matiere | |
| 5,380,123 | A * | 1/1995 | Ryynanen | 404/82 |
| 5,551,809 | A * | 9/1996 | Forsberg | 405/285 |
| 6,205,605 | B1 * | 3/2001 | Orsat | 14/26 |
| 7,478,450 | B2 * | 1/2009 | Fong | 14/77.1 |
| 8,220,095 | B2 * | 7/2012 | Schultz et al. | 14/77.1 |
| 8,448,279 | B2 * | 5/2013 | Cook | 14/77.1 |
| 2004/0123408 | A1 * | 7/2004 | Lee | 14/77.1 |
| 2007/0119004 | A1 * | 5/2007 | Fong | 14/77.1 |

* cited by examiner

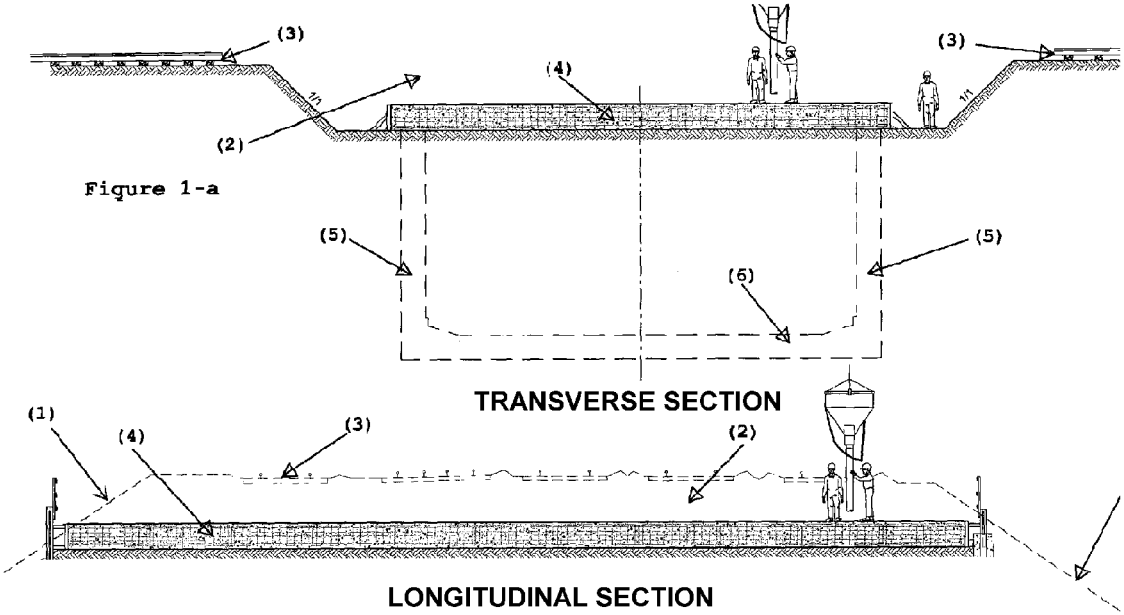
Figure 1-a
Figure 1-b

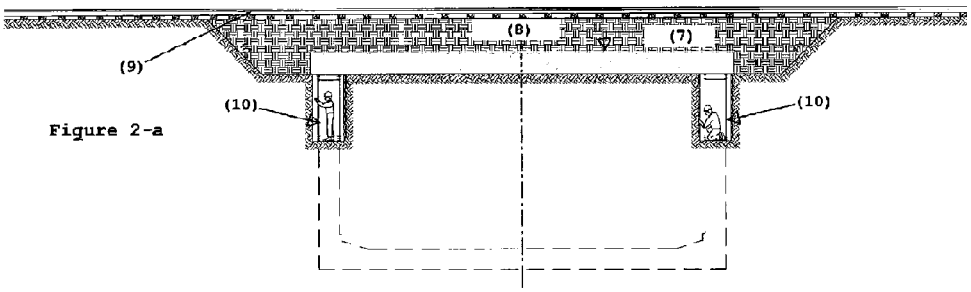
Figure 2-a
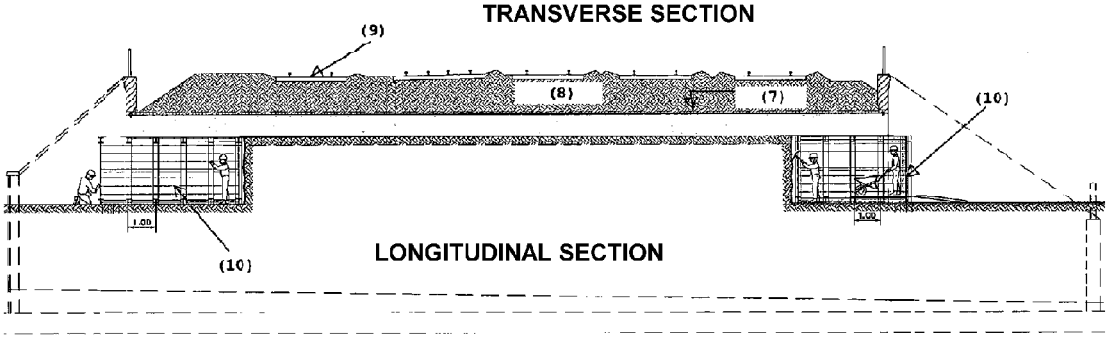
Figure 2-b

Figure 3-a
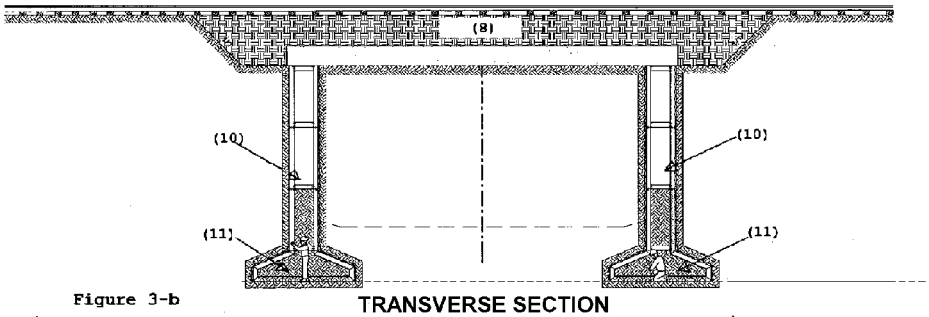
TRANSVERSE SECTION
Figure 3-b
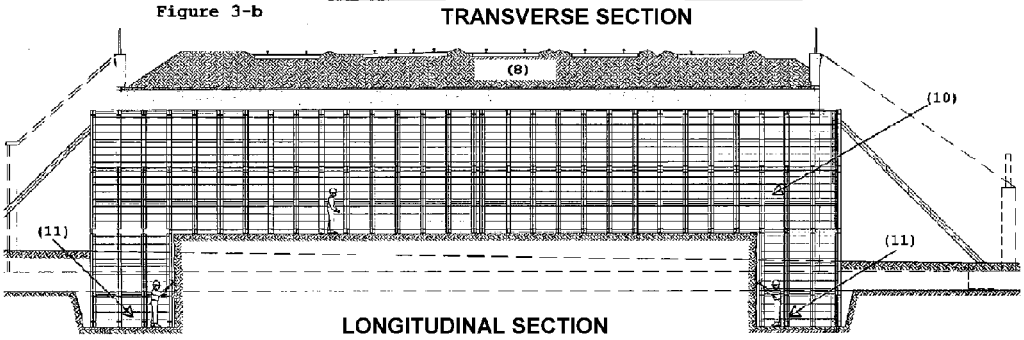
LONGITUDINAL SECTION Figure 4-a
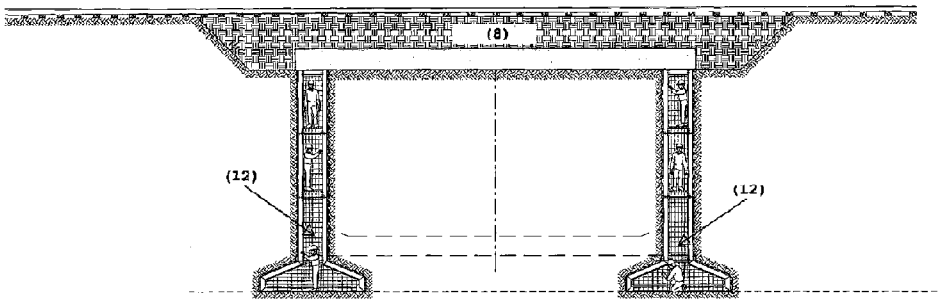
TRANSVERSE SECTION
Figure 4-b
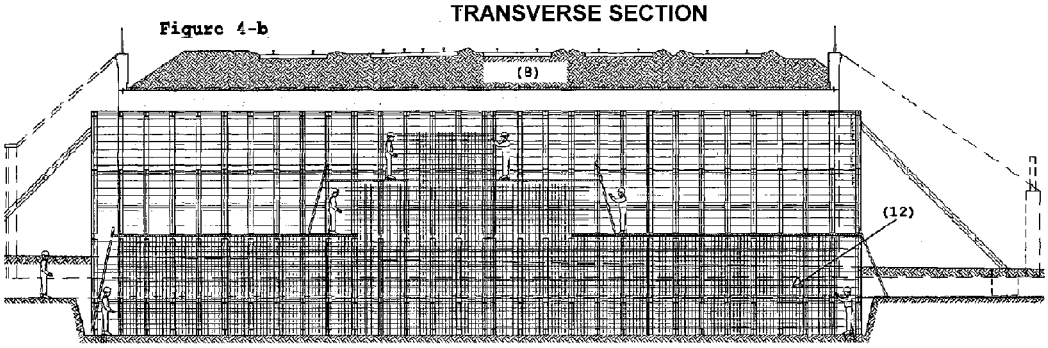
LONGITUDINAL SECTION Figure 5-a
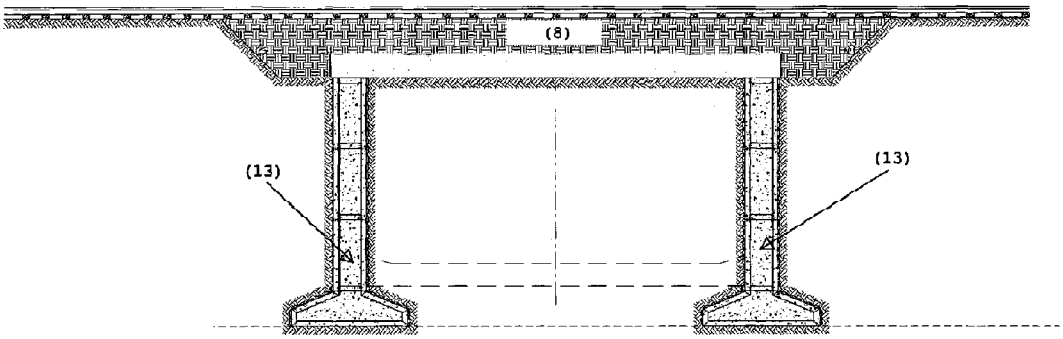
TRANSVERSE SECTION
Figure 5-b
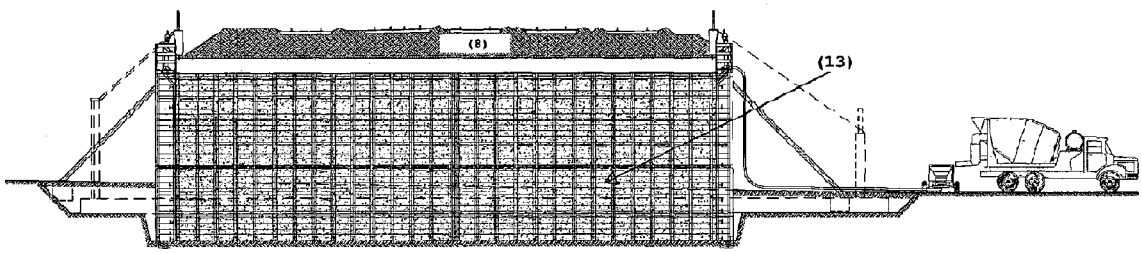
LONGITUDINAL SECTION Figure 6-a
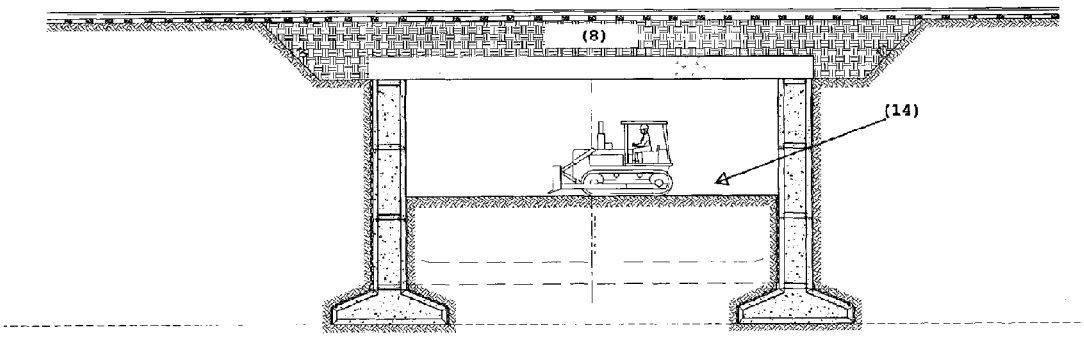
TRANSVERSE SECTION
Figure 6-b
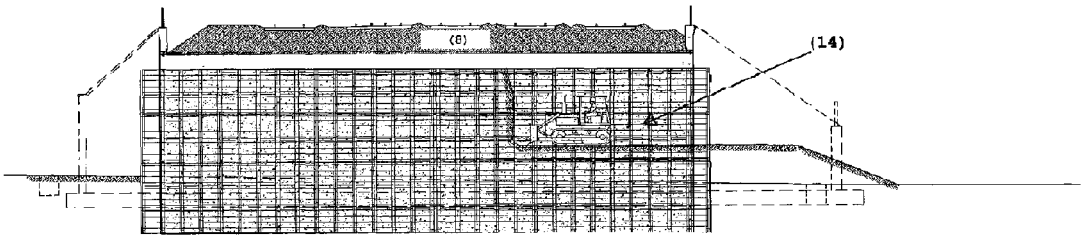
LONGITUDINAL SECTION Figure 7-a
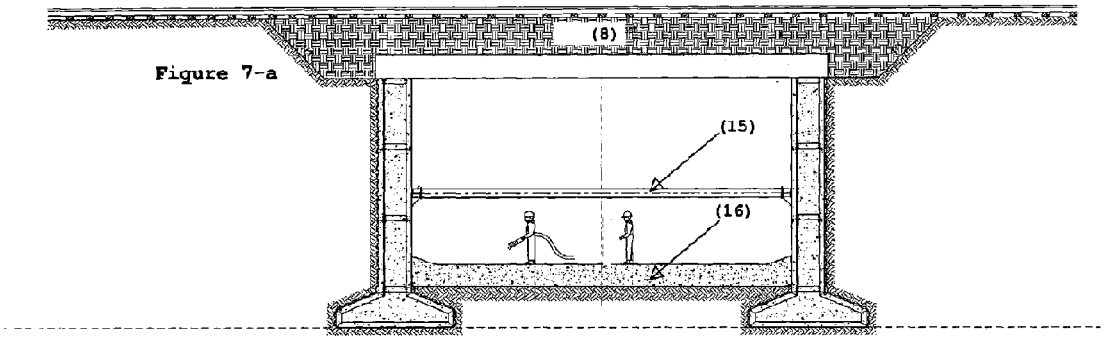
TRANSVERSE SECTION
Figure 7-b
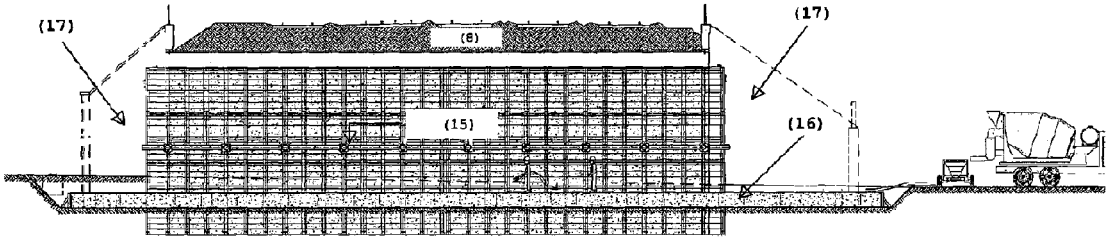
LONGITUDINAL SECTION

METHOD FOR BUILDING STRUCTURES, PARTICULARLY PASSAGES UNDER OPERATING RAILWAYS OR THE LIKE

The present invention relates to a method enabling rapid reliable and efficient construction of structures such as railway, highway, roads, pedestrian or other passages through any earthworks or embankment supporting one or multiple rail, highway, road or other ways without requiring prolonged stoppage of traffic flowing on these ways.

Reference can be made to the following methods in the known prior art:

Transverse sinking, under the embankment, of two pairs of half-abutments or recessed side walls, arranged in pairs opposite each other on both sides of sides delimiting the passage to be made and forming under the ways, between the latter and the upper face of the half-abutments, a limited thickness of backfill. The half-abutments are brought into abutment in pairs, substantially in the median longitudinal plane of the embankment, then fitted in their area of mutual junction on both sides of this median plane. Subsequently, stiffeners are mounted in place under the tracks over a length thereof slightly greater than that separating the two pairs of half-abutments, before or after the sinking thereof. The backfill is removed between the ways and the abutments joined under the stiffeners. Two base blocks supports are arranged on the two pairs of half-abutments respectively resting on these half-abutments. The stiffeners are removed and then the ways are severed over a length corresponding to the width of the passage. The backfill remaining between the base block is graded over a layer necessary for the enclosure of two prefabricated half decks installed on each side or a single side of the passage, these half decks being skidded laterally on the base block or on top of the abutments, in order to rest them jointly by their ends. The ways are reconstructed on the half-decks and the earthworks of the passage is completed between the two pairs of half-abutments beneath the ways.

A method comprising, after having cut the way over a length corresponding to that of the passage to be made thereunder, to form a concrete frame bordering this passage by means of two half U-section elements, arranged opposing on both sides of the embankment or earthworks supporting the way, gradually bringing together these half-elements by sinking relative to one another by driving them with force into the embankment until they come into contact, removing the cut via the inside of the half-elements as their penetration into the embankment progresses, then arranging on the frame a deck for supporting the way and finally reconstituting the latter along the length of the deck. The sinking comprises using jacks taking support from a side on at least one of the half-elements so that each of these half-elements alternately serve as an anchor point to the other, in order to provide an appropriate reaction to the thrust of the jacks. The sinking of the two half-elements is carried out by means of cables passing through the embankment, each cable being attached at one end to a half-element and joined at the other to a jack supported on the other half-element, so as to exert a traction force on the cable providing the mutual approaching of the two parts of the frame. It needs to be noted that this method requires the prior installation of auxiliary decks or temporary stiffeners.

A method called "Self-shifting", comprising, after having temporarily sectioned the way at the location provided in the support embankment of this way for the passage to be made, and having made a trench by excavation of the land in this location, and after having previously made or arranged, on at least one side of the trench, as needed in each of the two sides thereof on both sides of the embankment and opposing one another, at least a support and guide raft plate for each hollow concrete frame, the frame being supported by the raft at the exterior of the trench, to be installed, parallel to the lateral sides of the hollow frame, at least one traction cable, each cable being joined at one end to an anchoring projection provided on the raft supporting the frame and at the other end engaged with a jack supported by this frame, so that the traction force exerted on the cable by the jack is translated, as a result of the reaction on the anchoring projection, by a thrust effect on the frame which gradually slides on the raft, then on the floor of the trench in order to directly provide its penetration therein, in front of the raft. To facilitate the sliding, a layer of bentonite or another similar material, adapted to lubricate the mutually facing surfaces, is continuously injected between the lower face of each frame and the upper face of the raft guide.

A method according to the same principle described above, but "improved" by changing the geometry of the frame of the passage in order to avoid backfilling during the short period of traffic interruption. In fact, during the opening of the trench, inclined sides are formed through the embankment on which the way rests. The frame thus comprises, on each of its vertical sides, two extensions extending, for the first in the extension of its upper horizontal side and for the second obliquely arranged, so as to connect the opposite end of the extension at the base of the vertical side of the frame, this second extension having an inclination on the vertical substantially identical to that of the opposing flank of the embankment.

A technique called the "Protection vault", which comprises drilling, under the way of the terrain of the embankment that it supports, holes of relatively small diameter arranged side by side and extending traversely under the way, these holes enabling the installation of hollow metallic tubes into which, if required, can be injected a cement in order to make, after its hardening, horizontal piles or the like, as well as solid rigid profiles that thus reinforce the terrain by strengthening it, under the railroad track or the road, by forming, over the passage or tunnel to be made, a kind of rigid base block constituted by the juxtaposition of these tubes or rigid profiles. The terrain being thus excavatable before the construction of the walls of the tunnel without risk of collapse of the way. The base block thus created can have a plane or curved profile, above the passage or tunnel to be transversely formed in the embankment.

A method called "Self-drilling", which comprises arranging in opposition, on both sides of the embankment supporting the way, two half-abutments or like structures, in the form of identical hollow frames, closed or in half-U section, prefabricated of reinforced concrete, whose footing substantially corresponds to the cross section of the tunnel to be made, the front sections directed toward each other from these frames being preferably partially recessed in order to each form a lip with edges inclined on the vertical, these frames being progressively moved one towards the other through the embankment by means of traction cables controlled by the high power hydraulic jacks, the system being arranged such that the two frames are simultaneously moved towards each other or alternately, one of them being immobilized while the second is moved toward the first or vice versa. To this end, these cables are joined respectively to one of the frames and to the jack supported by the other frame so that the forces developed on these cables, by a suitable mounting of the jacks, causing the penetration of the frames into the embankment and their relative displacements towards one another. The area of the embankment in front of the frames progressively with their mutual or alternative coming together, is continuously removed, until, in the median plane of the structure, parallel to the direction of the way on top of the embankment, the two frames are joined with contact of their opposing lips, these frames then being fitted between themselves in their joining area in order to provide continuity of the tunnel thus made under the way.

An improvement of the method described above, which has two major disadvantages below:

During a short period of time but which nevertheless is not zero, it is necessary to limit, or even interrupt, the traffic while the frames come together, and/or install under this way auxiliary support decks or even stiffeners in order to prevent its collapse during the installation of the frames.

As a result of displacement of the frames, the part of the soil located above the latter and in front each of them, as they come closer under the effect of the traction cables, creates an infinity of reaction forces resulting from the friction, by producing an intense stirring of the part the soil engaged by the lips provided at the tip of the two frames and an increase of the volume of soil in front and above these lips, these forces having a result that causes a lifting force on the train track or the road, possibly creating irreparable damage to it, requiring immediate repair and a more or less prolonged interruption of the traffic, which is in total opposition with the original purpose of the method called "Self-drilling".

The improvement thus comprises combining this method with that of an protection vault forming, over moving frames, a support base block such that any traffic disruption be avoided, by eliminating the reaction forces and the lifting effect of the way as a result and further enabling that the vault be continuously supported along the entire length of the tubes or profiles that constitute it.

Skidding, after opening of the trench in the embankment, of the previously prefabricated structure using Self Propelled Modular Transporters (SPMT). The methodology is the following:

Prefabrication of the structure next to its final location as a frame culvert (thus without raft) then opening of the trench in the embankment at the future passage.

Assembly of lines of propelled trailers and installation of metal supports

Strengthening of the soil for the passage of trailers in order to obtain a certain soil load-bearing capacity.

Rolling of the trailers under the deck of the passage

Picking up the passage by jacking

Moving of the passage to its final position

Un-jacking of the structure then dismantling and removal of temporary equipment and trailers.

Backfilling of both sides of the abutments as well as above the deck and reestablishment of the traffic ways.

Skidding, after opening of the trench in the embankment, of the previously prefabricated structure by pushing on paths made of reinforced concrete longitudinal beam fitted with metal rails or Welded I-girder joined to a wood deck. The structure is elevated in order to separate it from its prefabrication tarmac, in order to obtain a sufficient ground clearance for its displacement, using a sufficient number of jacks positioned outside of the structure under metal cantilever connected to the side walls or abutments thereof. The driving system itself is located at the front and/or rear of the structure and provided by double-acting cylinders that are hydraulically gripped on the rails. The interface between the jacks and rail, providing the sliding of the structure, is constituted by Teflon/stainless steel or greased hardwood, or roller carriageway.

Skidding, after opening of the trench in the embankment, of the previously prefabricated structure by pushing on skid paths following the same principle described above. However the sliding interface is constituted by load modules in sufficient numbers and corresponding to the weight of the structure to be displaced. The carrying tables of the load module are filled with compressed air so that the structure can be skidded on the sliding tracks with an almost zero coefficient of friction. The air supply is provided by compressed air cylinders arranged in vertical frames positioned on the deck. A possible settlement of the skidding paths can be compensated by a separate maneuver of the hydraulic jacks of the load modules in the frame of their maximum stroke. After having reaching the final position, the skidding movement is blocked, the carrying tables of the load modules are vented and the structure is deposited on its final supports in a manner similar to the raising process.

Hoisting, after opening of the trench in the embankment, of the previously prefabricated structure, using mobile cranes having capacity adapted to the weight and reach of the structure to be displaced. This method is obviously used very little, because it is quickly faced with the heavy weight of structures to be displaced, generally on the order of hundreds, even thousands, of tons.

After having reviewed the various methods of the prior art, it should be noted that they all have, without exception, at least some, even multiple of the disadvantages recapitulated below:

More than a single temporary interruption of traffic on the supported ways is often necessary for the construction of the passage, particularly the preparatory work such as the displacement of power and telephone networks often bordering railroad tracks or roads, construction of the foundations auxiliary decks, construction of stacks for auxiliary decks, laying of auxiliary decks and their removal at the end of work.

Installation of auxiliary decks or temporary stiffeners in order to maintain traffic on the supported ways during the implementation of the structure. It should be noted that the introduction and removal of auxiliary decks is made using very specialized railway equipment having limited availability (and therefore expensive) forty meters long and equipped with forklifts: the hydrocampe gantry.

Need to reinforce the soil when skidding of the structure, in order to avoid even limited settlement, which can have serious consequences (financial, technical and in terms of delays) on the progress of the operation.

A lot of earthworks, which increase with the size of the structure (generally of the order of thousands of $m^3$) made of cut and backfill during the short period of interruption of traffic (only some hours) which requires the mobilization of very heavy equipment and labor means for a short period with a large financial impact.

Construction and installation of temporary structures not part of the final passage, including their removal/demolition and disposal at the end of the construction (booms and guide rafts with footing, sprag anchor, guide side beams and bosses for some, support devices and wings with local reinforcement gripping points and haulage pathways for others)

Construction of only hyperstatic structures, which is not the case for all passages.

After skidding of half frames, required their key stone installation at the midplane including shoring and rebar embedding and then injection of grout cement under the raft (and struts if they exist) in order to fill the gaps and join the structure with the ground in place.

The two major drawbacks common to all the methods cited above remain, of course, the cost and time more or less substantial depending on whether they aggregate more or less of the drawbacks mentioned above, especially the quantity and nature of the work to be performed in a very short time (only some hours) as well as the magnitude of temporary work, not involved in the construction of the final bridge, but essential to its implementation.

An object of the present invention is a method that enables rectification of these drawbacks, by enabling in particular reduction of the cost and time of the passage to made.

To this end, the method provides for making only the deck of the passage in a first step. In fact, after having interrupted a part or all of the traffic of the supported ways during a very short duration (a few hours) and removed the railway tracks or routes corresponding to this traffic, excavation commence in order to reach the level corresponding to the sub-slab of the deck (optionally augmented by some centimeters in order to enable a fine grading of the subgrade of the deck). Subsequently, the deck will be poured on site after having installed an adequate formwork side such as lightweight panels or alternatives as well as rebar fabricated cages and their recovery on site. The concrete used will be of the high performance, ultra-high performance or UHPC Fiber (Ultra-High Performance Concrete Fiber) type able to attain a sufficiently high resistance in only a few hours, thus enabling the deck to be optionally sealed, filled in and resumed with traffic right at the end of the period of disruption of the traffic.

After drying of the concrete, the deck will receive, if necessary, a sealing of the independent, semi-independent, dependent type, or any adequate method and will be backfilled with good quality materials such as treated gravels or alternatives. The rail, road or pedestrian traffic will then be restored after reconstitution of the rail, foot, or path ways.

Of course, according to the scenario (site configuration, available rights of way on the project site, duration of the temporary interruption of traffic) the deck can also be prefabricated in one or multiple elements, which will subsequently be skidded, hoisted using mobile cranes or moved by any other system, then keyed between themselves on site or assembled if necessary by prestressed cables or an alternative. The deck can also be made of a mixed steel/concrete structure. A variation includes making the deck of reinforced or prestressed concrete and combining two or multiple of these materials and implementation techniques.

In a second step, the side walls will be made by digging underground galleries in the backfill supporting the rail, road, or pedestrian ways, at the ends of the top slab made of concrete already set up during the short period of interruption of traffic. The galleries will have a width equivalent to that of the side walls. The shoring will be constituted by metallic profiles such as H-beam or similar fitted by plates made of steel, wood, concrete, or any other material. All the elements composing this shoring are hand carryable. A portion of this material will be abandoned in the field and the other part later recovered during the excavation under the top slab. The slope of the gallery will be dug manually, using hand carryable or other tools, in small increments depending on the soils encountered (on the order of approximately a meter) in order to provide at all times an inclination following the natural slope of the terrain in place, the goal being to avoid a possible landslide of the latter. Therefore, the gallery shoring and excavation are made simultaneously. The side wall will be extended in order to attain a sufficiently hard substratum and founded on interim and/or final foundations (this depends on the nature of the terrain encountered, whose load-bearing capacity varies from one place to another, for the same reason as the dimensions and shapes of foundations).

The reinforcement of side walls will be made by the installation of rebar fabricated cages or the assembly in the interior of the galleries of cut-and-bend reinforcement bars.

The concreting of the side walls will be made with self-consolidating concrete (SCC) or vibrated concrete after closing extremity using a dedicated formwork tool. It can also be made using high-performance concrete, ultra-high-performance fiber concrete or a combination of two or multiple of these materials.

A drainage system such as geocomposite sheet drains or another suitable adapted system is interposed between the final shoring "lost" in the gallery and the terrain in place It is evident that the work in the interior of the gallery, a confined space, will be carried out in optimal conditions of safety, notably by the installation of sufficient adequate artificial light as well as a mechanical ventilation enabling renewal of the air in the interior of the galleries while providing fresh air.

In order to provide the continuity of rebars at the side wall/top slab connections, dual-sleeves will be installed. The connection will be made as follows:

Providing and installation of deck rebar fabricated cages fitted with female (or male) sleeves at the connection with the future side wall.

After construction of the deck and tunneling of the galleries, providing of steel bars fitted with male (or female) sleeve and bonding by simple turning into the female (or male) sleeve already installed in the deck.

Note that this system enables meeting all the scenarios:

Standard connection: when the second bar is free to rotate

Connection without rotation: when the second bar cannot turn

Connection with diameter reduction: when the two bars have different diameters

However, a variation includes replacing the sleeves with rebar embedding in the deck or any other suitable system.

After drying of the concrete of the side walls, the excavation in the interior of the thus formed frame (in inverted U) can begin between the side walls and under the top slab. As the earthworks progresses, a part of the shoring will be removed, the deck optionally propped up, and the side walls temporarily and/or permanently stabilized using anchor rods, passive or active nails, struts and horizontal fendering or any other suitable system. The combination of two or multiple of these techniques can be considered. The bottom of the trench will be compacted, reinforced and concreted in order to make the bottom slab if necessary (depending on the wishes of the project manager and/or evidences of the design calculations). These operations are intended to avoid any detrimental movement of the frame of the structure.

This method thus provides a solution to various drawbacks of conventional methods, particularly by eliminating:

All temporary interruptions of traffic on the supported ways, except that necessary for the implementation of the deck only (and not the entire bridge) which is of course considerable lower than that relating to the methods previously described.

The installation of the auxiliary decks or temporary stiffeners in order to maintain the traffic on the supported ways during the implementation of the structure, since they will not be absolutely necessary.

The reinforcement of the subgrade of the structure as in the skidding solutions, since the structure is made directly at its final position, avoiding at the same time any inconvenience as a result of possible settlements.

The construction and installation of temporary structures whose utility is dictated only by the procedure used (Self-shifting, skidding on rolling path, . . . ). In fact, all these methods are based on a preliminary prefabrication of the structure outside its final location then its subsequent movement. This is not the case of the method of this invention.

The key stone installation of the half frames as well as the injection of cement grout under the raft (and struts if they exist) as in the case of Self-shifting or Self-drilling.

And by considerably reducing:

The excavation and backfilling during the short period of interruption of traffic on the ways supported by the future passage, passing from a few thousand $m^3$ to only a few hundred $m^3$, reducing at the same time the necessary manpower and material means. In fact, only the deck will be implemented during this critical period of temporary interruption of traffic of only some hours, unlike conventional methods, which provide for the installation of the entire structure, thus leaving very little margin in case of unforeseen events such as water gushers for example, accidental shutdown of earthworks and skidding gear or any other incident (hence the doubling of all these means as well as the provision of other means overcoming unexpected events even if this uncertainty is minimal).

Another advantage of the method of this invention includes making isostatic or hyperstatic structures or both at the same time, by making fixed and/or mobile Bearings.

The accompanying drawings represent in very broad outline, in transverse and longitudinal sections, the method of making a passage according to the invention.

FIGS. 1-*a* and 1-*b* show: The removal of ways, excavating at the structure to the level of the sub-slab of the top slab of the passage, then construction of the latter.

FIGS. 2-*a* and 2-*b* show: The backfill above the deck, re-laying of the ways with restoration of the traffic and tunneling of the foundation galleries by successive passes.

FIGS. 3-*a* and 3-*b* show: The continuation of tunneling work of the galleries up to the final pass as well as the footings.

FIGS. 4-*a* and 4-*b* show: The reinforcement of the side walls and footings.

FIGS. 5-*a* and 5-*b* show: The concreting of the side walls and footings.

FIGS. 6-*a* and 6-*b* show: The excavation in the interior of the passage to the level of the raft.

FIGS. 7-*a* and 7-*b* show: The construction of the raft and the end of construction of the passage.

FIG. 8 shows: A transverse section of the completed underpass.

With reference to the accompanying drawings, the method provides, after interruption of the train traffic for some hours (the time of a weekend, for example) and removal of rail lines (3) at the future passage (shown in dashed lines by the location (5) of the future side walls and the location (6) of the future raft) to be made in the embankment (1) supporting these ways, effecting a small excavation (2) in the embankment, having as trench base the underside of the future deck (4) to be made in accordance with FIG. 1.

After rapid drying of the concrete of the deck, it will receive an adapted sealing complex (7) and will be backfilled with suitable material (8). Thus rails (9) can be put back above the deck and ballasted before the restoration of railway traffic at the end of the interruption period.

Once the deck is buried and the traffic resumed, the construction works of the side walls (10) can begin. In fact, they will be carried out by tunneling galleries having a width equal to that of the final side walls, by successive passes, manually cased, as the earthworks is effected using manually carried tools. The tunneling of the galleries will continue to the level of the superficial footings (11) of the side walls. These can be temporary or permanent (their dimensions and shapes depend on the terrain encountered on site and will be wide enough to enable labor workers in better security conditions). At the end of the earthworks, the rebars (12) will be implemented and formwork will completely shut the extremity of the galleries on their full height.

The concreting of the side walls can then begin by filling the galleries using self-compacting concrete (13).

After hardening of the side walls, excavation under the top slab (14) will be carried out in the interior of the passage using appropriate gear while installing struts and bridgings (15) mid-height of the side walls.

Once the bottom of the trench is reached, it will be compacted, cased on the outside edges, reinforced then concreted in order to make the raft (16) of the passage.

The wing and/or return walls (17) can then be constructed, the equipment set up in a conventional manner and the side walls arranged (these operations are not part of the method since they are independent of the temporary interruption of the traffic: The method relates to the construction of the structure of the passage: Supports, deck, foundations and optional raft).

It is evident that the invention, of course, is not limited to the implementation example more particularly described above with reference to the accompanying drawings, but other variants, within the scope of the following claims, are capable of application according to the same global principle.

The method according to the invention enables the construction of structures such as railway, highway, road, pedestrian or other passages through any earthworks or embankment supporting one or multiple railways, highways or roads without requiring prolonged stoppage of the traffic flowing on these ways.

The invention claimed is:

1. A method enabling the construction of structures such as underpasses (passages under railway, highway, road, pedestrian way), through earthworks or embankment supporting one or multiple railway, motorway, roadway, pedestrian way, after having temporarily interrupted the flow of the traffic on these ways, the method comprising:

removing the ways or a part thereof, at the place provided in the embankment support of these ways for the future passage to be made, sufficiently excavating the embankment, implementing a deck, then its backfilling and putting back the ways in order to restore the traffic at the end of the period of temporary traffic interruption; and making the side walls of the passage from the sides of the embankment, by the making of galleries sunk to the level of foundations, the construction of the aforementioned foundations according to the characteristics of the soils encountered, the making of side walls in the interior of the galleries, then excavations in the interior of the passage, with installation of temporary and/or final retaining structures and shorings in order to avoid detrimental movement of the frame of the structure.

* * * * *